US005547281A

United States Patent [19]

Brooks

[11] Patent Number: 5,547,281

[45] Date of Patent: Aug. 20, 1996

[54] APPARATUS AND PROCESS FOR PREPARING FLUIDS

[75] Inventor: John R. Brooks, Brenham, Tex.

[73] Assignee: Phillips Petroleum Company, Bartlesville, Okla.

[21] Appl. No.: 321,068

[22] Filed: Oct. 11, 1994

[51] Int. Cl.[6] ..... B01F 5/00

[52] U.S. Cl. ..... 366/340; 366/176.1; 366/336

[58] Field of Search ..... 366/336, 340; 138/40, 44, 37

[56] References Cited

U.S. PATENT DOCUMENTS

| | | | |
|---|---|---|---|
| 2,304,456 | 12/1942 | Hall | 138/44 |
| 2,929,248 | 3/1960 | Sprenkle | 138/40 |
| 3,417,967 | 12/1968 | Richens | 366/340 |
| 4,352,572 | 10/1982 | Chen | 366/340 |
| 4,383,769 | 5/1983 | Pandolfe | 366/340 |
| 4,514,095 | 4/1985 | Ehrfeld | 366/340 |
| 4,854,721 | 8/1989 | Hume | 366/340 |
| 4,869,849 | 9/1989 | Hirose et al. | 366/34 |

*Primary Examiner*—David Scherbel
*Assistant Examiner*—Terrence R. Till
*Attorney, Agent, or Firm*—Lucas K. Shay

[57] ABSTRACT

An apparatus for fluid flow communication is disclosed which comprises a substantially tubular member having first and second opposite end portions; a first end wall secured to and closing the first end portion of said substantially tubular member wherein the first end wall has at least one first aperture extending therethrough; a second end wall secured to and closing the second end portion of the substantially tubular member wherein the second end wall has at least one second aperture extending therethrough; an intermediate wall disposed within the substantially tubular member intermediate the first and second end walls and having a circumferential outer edge; and support means disposed within the substantially tubular member for fixedly securing the intermediate wall relative to the inner surface of the substantially tubular member whereby the circumferential outer edge of the intermediate wall and the inner surface of the substantially tubular member define a substantially annular passage. A process for mixing a drilling fluid comprises passing components of the drilling fluid through the apparatus.

19 Claims, 5 Drawing Sheets

APPARATUS AND PROCESS FOR PREPARING FLUIDS

FIELD OF THE INVENTION

The present invention relates to an apparatus useful for preparing a water-based or oil-based fluid and a process for using the apparatus for preparing the fluid.

BACKGROUND OF THE INVENTION

Water-based or oil-based fluids such as, for example, drilling fluids, milling fluids, mining fluids, water-based metal working fluids, food additives and paints, are useful in a variety of industrial applications. It is well known to those skilled in the art of drilling wells that in order to tap subterranean deposits of natural resources, such as gas, geothermal steam or oil, especially when drilling by the rotary method or the percussion method wherein cuttings must be removed from the bore hole, it is necessary to use a drilling fluid.

The use of water-based or oil-based fluids in, for example, workover and completion fluids in oil field operations is also well known to those skilled in the art. Workover fluids are those fluids used during remedial work in a drilled well. Such remedial work includes removing tubing, replacing a pump, cleaning out sand or other deposits, logging, etc. Workover also broadly includes steps used in preparing an existing well for secondary or tertiary recovery such as polymer addition, miceliar flooding, steam injection, etc.

Completion fluids are those fluids used during drilling and during the steps of completion, or recompletion, of the well. Completion operation can include perforating the casing, setting the tubing and pump, etc. Both workover and completion fluids are used in part to control well pressure, to stop the well from blowing out while it is being completed or worked over, or to prevent the collapse of casing from over pressure.

Chemicals are added to the water-based or oil-based fluids for various reasons that include, but are not limited to, controlling water loss, increasing viscosity, reducing corrosion, inhibiting biodegradation, and increasing the density of the fluids. For example, chemicals such as, for example, water-thickening polymers serve to increase the viscosity of the water-based or oil-based fluids when used as drilling fluids, workover fluids or completion fluids, to retard the migration of the brines into the formation and to lift drilled solids from the wellbore.

It has been discovered that it is very difficult to completely dissolve or disperse a solid or gelled substance such as a polymer, especially a polymer that is stable in hostile environments, in a water-based or oil-based fluid resulting in a fluid whose rheology properties are often less than desirable for oil field applications. Frequently, because of incomplete dissolution or dispersion of a polymer, a higher quantity of the polymer has to be used in order to prepare a fluid having the desired rheology properties resulting in increased costs. It is therefore highly desirable to develop an apparatus and a process for improving the mixing of a polymer in a fluid.

SUMMARY OF THE INVENTION

An object of the present invention is to provide an apparatus which can be used in preparing a water-based or oil-based fluid. Another object of the present invention is to provide an apparatus for shearing a polymeric material in the preparation of a water-based or oil-based fluid. A further object of the present invention is to provide a process for preparing a water-based fluid for use in oil field applications. Still another object of the present invention is to reduce the cost of preparing a water-based or oil-based fluid for use in oil field applications. Other objects, features, advantages, and aspects will become more apparent as the invention is more fully disclosed hereinbelow.

In accordance with a first embodiment of the present invention, an apparatus is provided which comprises a substantially tubular member having first and second opposite end portions, an inner surface and an outer surface; a first end wall having an inner surface and an outer surface and secured to and closing the first end portion of said substantially tubular member and having at least one first aperture extending therethrough between the inner and outer surfaces thereof; a second end wall having an inner surface and an outer surface and secured to and closing the second end portion of said substantially tubular member and having at least one second aperture extending therethrough between the inner and outer surfaces thereof; an intermediate wall disposed within said substantially tubular member intermediate said first and second end walls, saaid intermediate wall having a first surface facing said first end wall, a second surface facing said second end wall and a circumferential outer edge; and support means disposed within said substantially tubular member for fixedly securing said intermediate wall relative to the inner surface of said substantially tubular member whereby the circumferential outer edge of said intermediate wall and the inner surface of said substantially tubular member define a substantially annular passage; wherein the inner surface of said substantially tubular member, the inner surface of said first end wall, and the first surface of said intermediate wall define a first chamber; wherein the inner surface of said substantially tubular member, the inner surface of said second end wall, and the second surface of said intermediate wall define a second chamber; and wherein said substantially annular passage provides fluid flow communication between said first and second chambers.

In accordance with a second embodiment of the present invention, a process for fluid communication is provided which comprises conveying a fluid through an apparatus which is disclosed in the first embodiment of the invention.

DETAILED DESCRIPTION OF THE INVENTION

The apparatus of the present invention can be used in a variety of applications dealing with fluid preparation such as, for example, the preparation of a drilling fluid. The term "fluid" used in the present invention is referred to, unless otherwise indicated, as a substantially liquid substance including water, a solution, a suspension, an emulsion, a non-aqueous fluid such as hydrocarbon, and combinations of two or more thereof.

Figure 1:
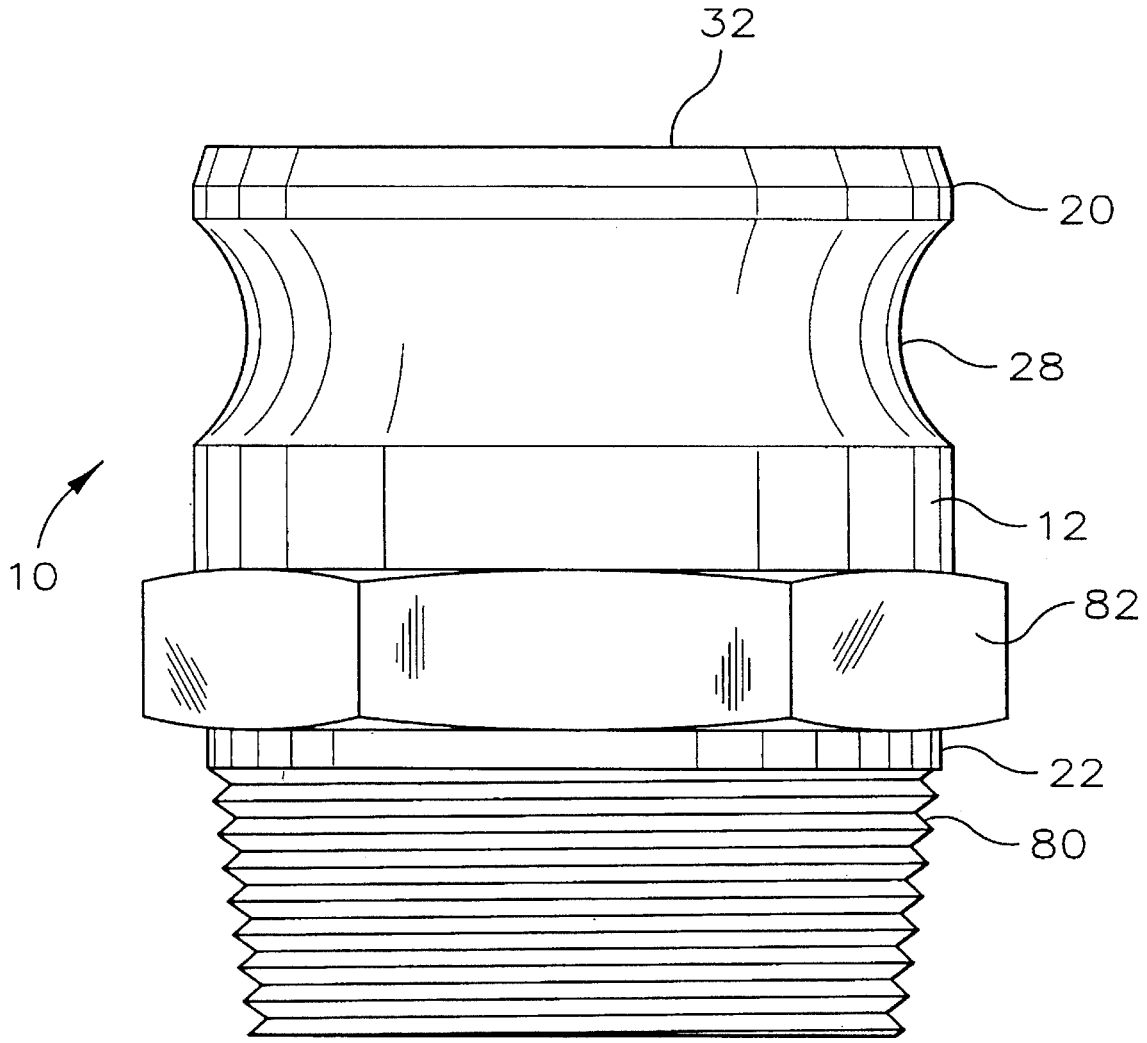
FIG. 1 is a side elevation view of a preferred embodiment of an apparatus in accordance with the present invention.

Referring now to FIG. 1, there is illustrated a preferred embodiment of the apparatus 10 of the present invention which is generally designated by the reference character 10. Apparatus 10 comprises a substantially tubular member 12 having at least two wrench flats 82 and an externally threaded portion 80 for connecting the apparatus 10 in fluid flow communication to a fluid conduit, vessel, or other similar structure. However, any other means known to one skilled in the art can be used to replace the externally threaded portion 80, or wrench flats 82, or both, for facilitating the connection and disconnection of the apparatus 10 from a fluid conduit, vessel, or other similar structure.

Figure 2:
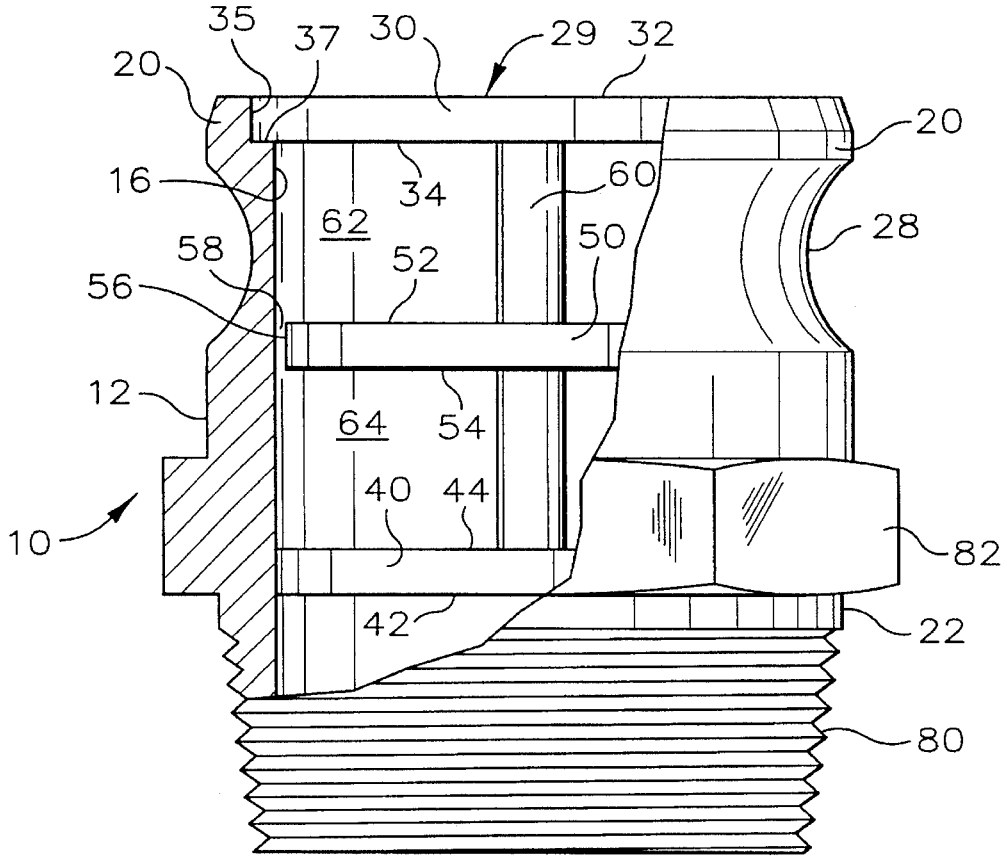
FIG. 2 is a partial cut-away view of FIG. 1.
Figure 4:
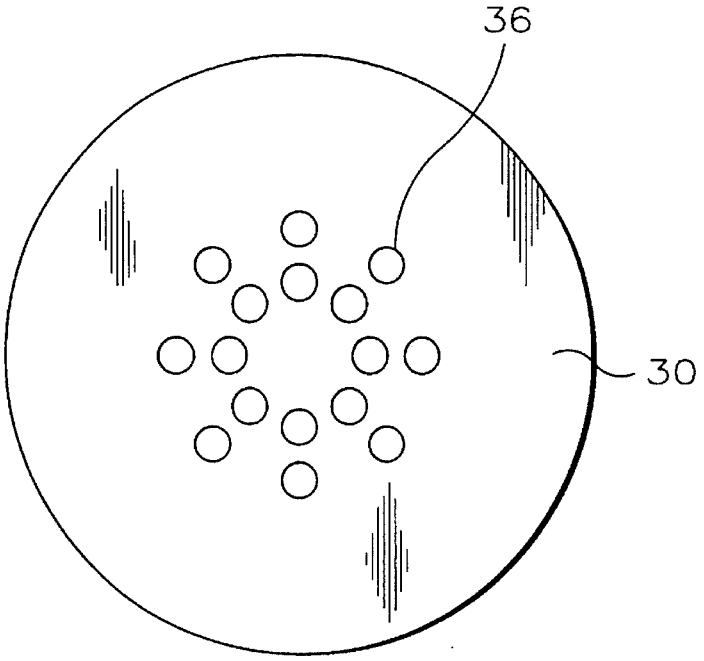
FIG. 4 is a top plan view of the apparatus shown in FIG. 3.
Figure 5:
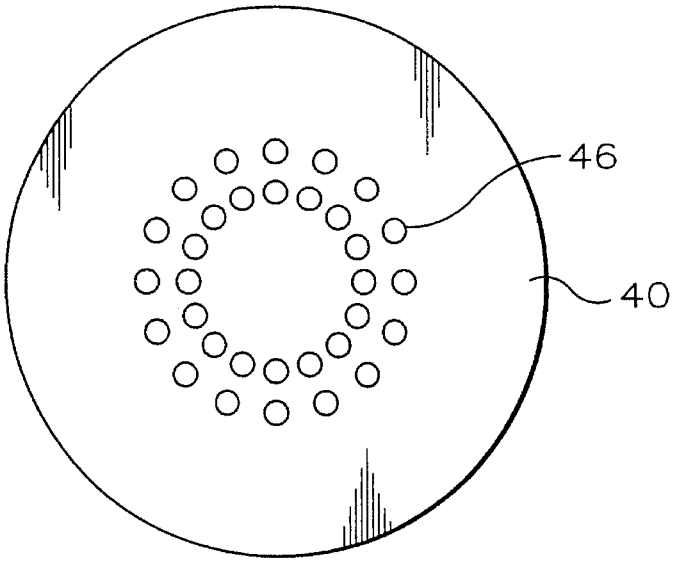
FIG. 5 is a bottom plan view of the apparatus shown in FIG. 3.

FIG. 2 shows that the apparatus 10 includes a substantially tubular member 12 having a first end portion 20 and an opposing second end portion 22. The substantially tubular member 12 has an outer surface, which is generally cylindrical adjacent the first end portion 20, and an inner surface 16. The first end portion is secured to and closed with a first end wall 30. The first end wall 30 has an outer surface 32 and an inner surface 34 and has at least one first aperture 36 (see FIG. 4) extending through the first end wall 30 between the outer surface 32 and inner surface 34. The second end portion 22 of the substantially tubular member 12 is secured to and closed with a second end wall 40 having an outer surface 42 and an inner surface 44. At least one second aperture 46 (see FIG. 5) extends through the second end wall 40 between the outer surface 42 and inner surface 44. The number of apertures 36 and 46 can vary depending on desired applications and can be as many as about 500, preferably from about 10 to about 200, and most preferably from about 10 to about 50 for preparing a fluid containing a polymer. Between the first and second end walls 30 and 40, there is an intermediate wall 50 having a first surface 52 facing the first end wall 30 and a second surface 54 facing the second end wall 40. The intermediate wall 50 also has a circumferential outer edge 56. The first end wall 30, intermediate wall 50, and second end wall 40 are connected by a suitable means such as a rigid member or standoff 60.

It is preferred that the inner surface 16 of the substantially tubular member 12 is generally cylindrical and that the circumferential outer edge 56 of the intermediate wall 50 is generally circular and coaxial with the generally cylindrical portion of the inner surface 16 of the substantially tubular member 12. A substantially annular passage 58 exists between the circumferential outer edge 56 and the inner surface of the substantially tubular member. It is presently preferred that at least the portion of the inner surface 16 of the substantially tubular member 12 adjacent the intermediate wall 50 is generally cylindrical and that the circumferential outer edge 56 of the intermediate wall 50 is circular and coaxial with the generally cylindrical portion of the inner surface 16 of the substantially tubular member 12.

Generally, it is presently preferred that the total cross sectional area of the at least one first aperture 36, the total cross sectional area of the substantially annular passage 58, and the total cross sectional area of the at least one second aperture 46 are substantially equal. It is, however, within the scope of the present invention for these cross sectional areas to vary in magnitude one from the other.

It is also preferred that each of the first apertures 36 is circular in cross section and the diameter of each of the first apertures 36 is larger than the minimum distance between the circumferential outer edge 56 of the intermediate wall 50 and the inner surface 16 of the substantially tubular member 12. It is also preferred that each of the second apertures 46 is circular in cross section and the diameter of each of the second apertures is smaller than the minimum distance between the circumferential outer edge 56 of the intermediate wall 50 and the inner surface 16 of the substantially tubular member 12.

A first chamber 62 is defined by the inner surface 16 of the substantially tubular member 12, the inner surface 34 of the first end wall 30, and the first surface 52 of the intermediate wall 50. A second chamber 64 is defined by the inner surface 16 of the substantially tubular member 12, the inner surface 44 of the second end wall 40, and the second surface 54 of the intermediate wall 50. The first and second chambers 62 and 64 are connected in fluid flow communication via the substantially annular passage 58.

Figure 3:
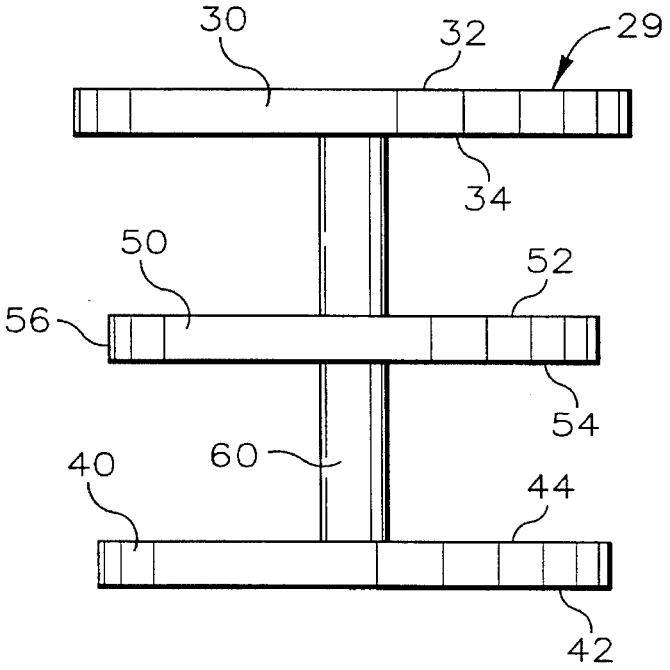
FIG. 3 is a side elevation view of the interior element of the apparatus of FIG. 1.

It is presently preferred that the first end wall 30, the second end wall 40, the intermediate wall 50, and the rigid member 60 are rigidly mutually interconnected as a unitary subassembly 29, as illustrated in FIG. 3. The unitary subassembly 29 can be suitable formed on a lathe from a single billet of solid material such as, for example, carbon steel, stainless steel, aluminum, plastics, or the like. Alternatively, the unitary subassembly 29 can be formed by molding, casting, or other techniques well known to one skilled in the art.

As shown in FIG. 2, the unitary subassembly 29 is preferably installed within the substantially tubular member 12 with the second end wall 40 closely slidingly disposed within the substantially tubular member 12 adjacent the second end portion 22 thereof. The first end wall 30 is closely slidingly received within a circumferential recess 35 formed in the inner surface 16 of the substantially tubular member 12 at the first end portion 20 thereof. The inner surface 34 of the first end wall 30 is positioned in abutting sealing relation with a radially outwardly extending shoulder 37 of the recess 35. The first end wall 30 can be fixedly secured within the recess 35 by any suitable means such as, for example, threaded mutual engagement, shrink or press fit, crimping, staking, adhesive, welding, snap ring, or the like.

Figure 6:
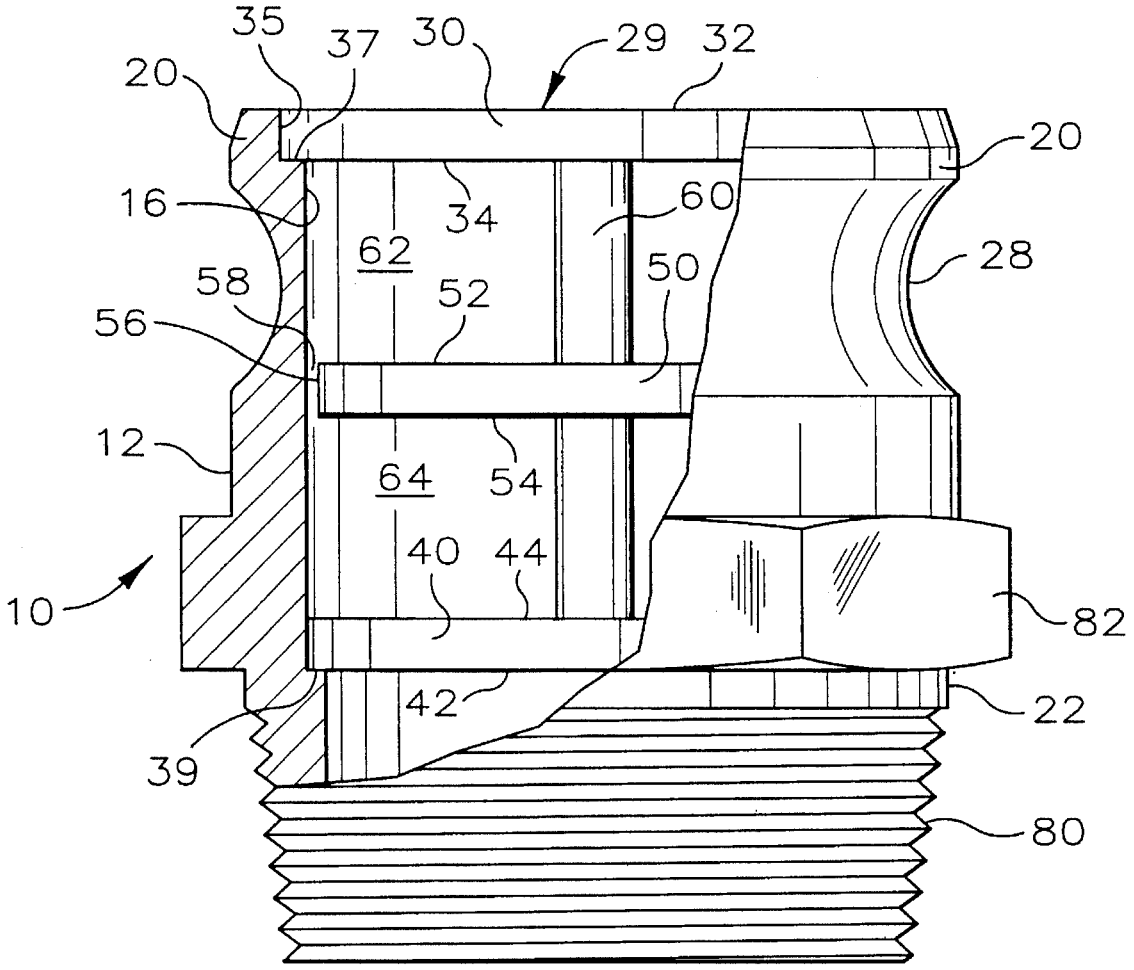
FIG. 6 is an embodiment of the apparatus of the present invention.

Alternatively, the second end wall 40 can be closely slidingly disposed within the substantially tubular member 12, having a radially inwardly extending shoulder 39 (FIG. 6) at the second end portion 22, and in abutting relation with the radially inwardly extending shoulder of the substantially tubular member 12. Therefore, the first end wall 30 can be slidingly disposed with the first end portion 20 of the substantially tubular member 10 (FIG. 6). The first end wall 30 can also be fixedly secured with any known means such as for example, threaded mutual engagement, shrink or press fit, crimping, staking, adhesive, welding, snap rings, and other means.

The substantially tubular member 12 can also include an externally threaded portion 80 formed on the outer surface adjacent to the second end portion 22 of the substantially tubular member 12. The externally threaded portion 80 provides means for fixedly securing to the substantially tubular member 12 in fluid flow communication with other apparatus. It is generally preferred that the externally threaded portion 80 be constructed of the same piece of material such as, for example, stainless steel, as the substantially tubular member 12. To facilitate the threaded connection of the substantially tubular member 12 in fluid flow communication with other apparatus, it is also preferred that there be at least one pair of parallel wrench flats 82 formed on the outer surface of the substantially tubular member 12 proximate the externally threaded portion 80. However, as disclosed earlier, any other means can also be used in place of the wrench flats.

It is preferred that the apparatus be constructed in such a manner that the apparatus can be readily disassembled so that the subassembly 29 shown in FIG. 3 which comprises the first end wall 30, intermediate wall 50, and second end wall 40 connected by the rigid member 60 can be removed from the housing by any means such as, for example, tapping the second end wall 40 with a tapping means such as wooden hammer. This is considered to facilitate cleaning of the apparatus. It can also use a snap ring to secure the subassembly 29 in place.

Any known material such as, for example, plastics and metals that can resist an elevated pressure during an oil field operation can be used to construct the apparatus. Preferably the apparatus is constructed of stainless steel.

Figure 7:
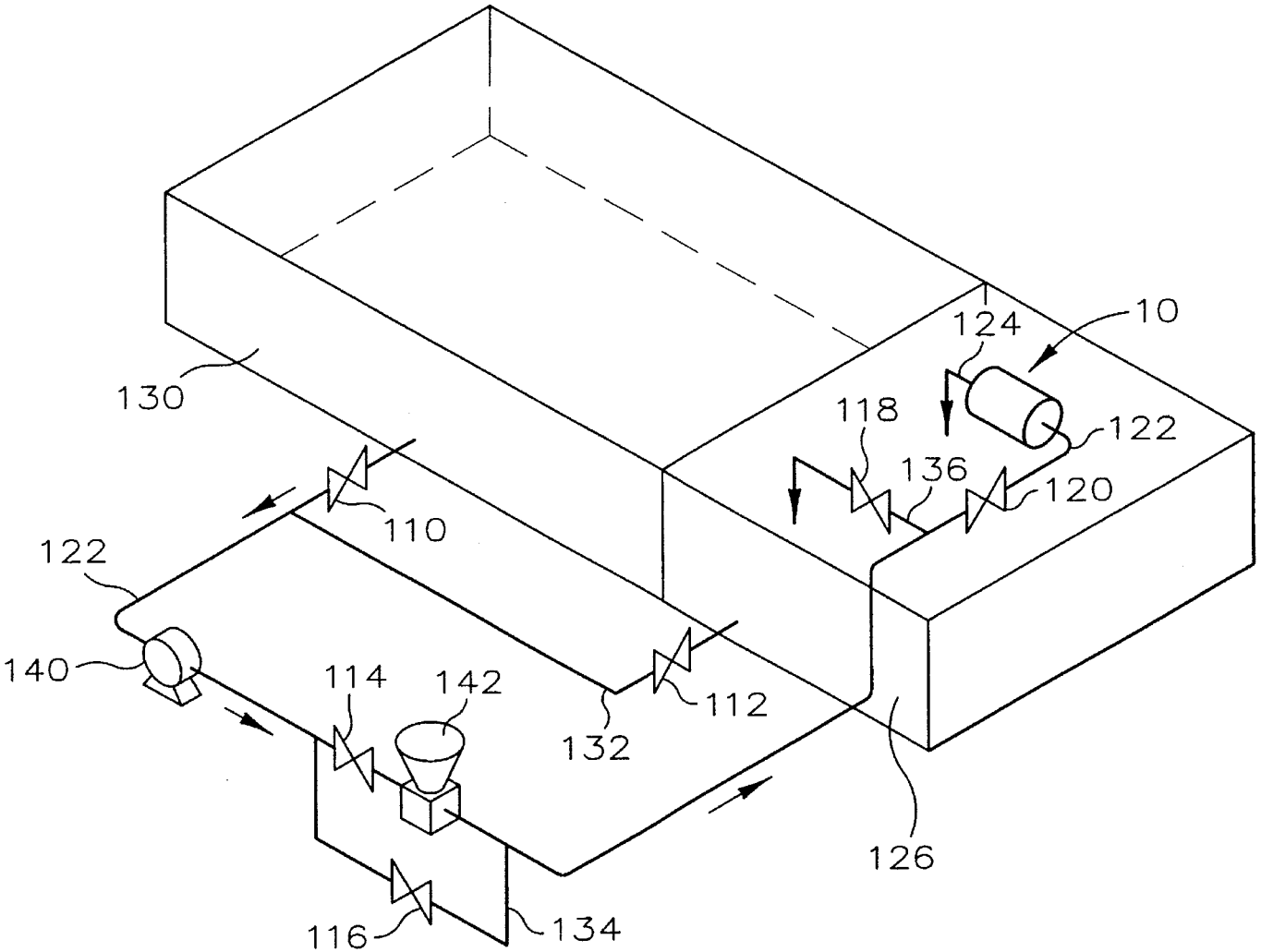
FIG. 7 is a diagrammatic illustration of a system used for preparing a drilling fluid using an apparatus in accordance with the present invention.

Referring now to FIG. 7, a fluid flow communication system can comprise the apparatus 10 of the invention which is attached to a first fluid conduit 122. Conduit 122 can be made of any suitable materials such as, for example, rubber. The first end portion of the conduit 122 is attached to the first end portion 20 of the substantially tubular member 12. As shown in FIG's. 1 and 2, the outside surface of the preferred embodiment of the first end portion of the apparatus 10 of the invention has a recessed area 28 which is provided for ease of attaching the first end portion of the conduit 122 to the first end portion 20 of the substantially tubular member 12. The conduit 122 can then be secured, by using a securing means such as, for example, a circumferential hose clamp, to the substantially tubular member 12. A fluid can flow through the conduit 122 and the apparatus 10 of the invention. The fluid flow therethrough is discharged to a first fluid container 126 through a second fluid conduit 124 which is preferably attached to the externally threaded portion 82 of the substantially tubular member 12 of the invention. Both the first fluid conduit 122 and the second fluid conduit 124 are in fluid flow communication with the substantially tubular member 12. The second end portion of the fluid conduit 122 is connected to an outlet portion of a second fluid container 130.

The first fluid container 126 has an inlet and an outlet wherein the outlet is connected to a third fluid conduit 132 which is in fluid flow communication with the first fluid conduit 122.

Additionally, a by-pass fluid conduit 134, which is in fluid flow communication with the first fluid conduit 122 provide means for conveying fluid from the fluid containers without flowing through an additive addition device 142. Similarly, a fourth fluid conduit 136 can be used if it is not desirable to convey a fluid through the apparatus 10.

A pump 140 which is in fluid flow communication with the first fluid conduit 122 is interposed in fluid flow conduit 122 to provide means for conveying fluid from the second fluid container 130 through the fluid conduit 122, or a by-pass fluid conduit 134, or the fourth fluid conduit 136 which is in fluid flow communication with fluid flow conduit 122, or to the apparatus 10 and finally to the first fluid container 126.

An additive addition device 142, which is in fluid flow communication with the fluid conduit 122, such as, for example, a hopper, is interposed in the first fluid conduit 122 and provides means for adding an additive to the fluid.

Valves 110, 112, 114, 116, 118 and 120 are interposed in the fluid flow conduits 122, 132, 122 (to the additive addition device 142), 134, 136, and 122, respectively, and provide means for controlling the flow of a fluid.

According to the second embodiment of the invention, a process for fluid flow communication is provided which comprises conveying a fluid from either the first fluid container 126 or the second fluid container 130 through fluid flow conduit 122 or 132, respectively, wherein the fluid conduit 122 has first and second end portions with the first end portion thereof connected in fluid flow communication to the first end portion 20 of the substantially tubular member 12 for conveying fluid therethrough to the second end portion 22 of the substantially tubular member 12.

Obviously, many modifications and variations of the present invention are possible in light of the above disclosures. It is therefore to be understood that within the scope of the appended claims, the invention may be practiced otherwise than as specifically disclosed.

The following examples are intended to assist one skilled in the art in understanding the present invention and are not intended to unduly limit the scope of the present invention.

EXAMPLE I

This example illustrates the preparation of a workover fluid useful for an oil field operation using conventional mixing apparatus following the drawing shown in FIG. 7.

In the first step, a salt water was prepared in container 130. The salt water was made to weight 8.9 pounds per gallon by adding regular salt to a sea water. An aliquot (50 barrels or 2,100 gallons) of the salt water was introduced to fluid container 126 through valve 100, pump 140, valve 116, and valve 118.

After container 126 was filled with 50 barrels of the salt water, valves 110, 116 and 120 were closed and valve 114 was opened. The salt water in container 126 was conveyed through the fluid conduits 132, 122, and 136 employing the pump 140 back to container 126. An additive containing 10 pounds of caustic soda, 200 pounds of XCD polymer (a Kelzan® biopolymer commercially available from Kelco, San Diego, Calif.), and HEC-10 biopolymer (a hydroxyethylcellulose polymer commercially available from Aqualon, a Division of Hercules, Inc., Wilmington, Del.) which had been thoroughly mixed was added to the salt water through the additive addition device 142 in the form of a hopper to prepare a workover fluid. The additive was added to the salt water at a rate such that addition of the additive was completed at about the time 50 barrels of the salt water in the container 126 was completely withdrawn by the pump 140.

The second step was the mixing of the fluid. After the addition of the additive was complete, valve 114 was closed and valve 116 was opened. The workover fluid in container 126 was further mixed for 45 minutes by circulating the fluid through the pump 140 and the conduit 134. However, after 45 minutes of mixing, the additive (polymers) was not visibly completely dissolved or dispersed in the salt water solution because some lumps of the additive were discernable. The viscosity of the suspension was about 80 centipoise.

EXAMPLE II

This example illustrates the preparation of a workover fluid using the process of the present invention.

The first step of the preparation was carried out the same as that disclosed in Example I with the exception that the workover fluid suspension in container 126 was circulated through the apparatus 10 of the present invention, and that only 150 pounds of XCD polymer and 25 pounds of HEC-10 polymer were used. Valve 112 was opened while valves 110, 114, and 118 were closed to allow the suspension to be conveyed to the apparatus 10 of the invention. Thereafter, the workover fluid was mixed as disclosed in Example I. After about 15 minutes of mixing, the polymers were almost completely or dispersed in the workover fluid. The viscosity of the workover fluid was about the same as that prepared in Example I.

After repeated operations at an off-shore drilling rig, it was found that on the average the XCD polymer and the HEC-10 polymer required to prepare workover fluids having about the same viscosity as that shown in Exmaple I were reduced by about 25% and 50% respectively. Furthermore, the time required to prepare a workover fluid having a comparable rheology property was reduced by about two-thirds.

The results shown in the above examples clearly demonstrate that the present invention is well adapted to carry out the objects and attain the ends and advantages mentioned as well as those inherent therein. While modifications may be made by those skilled in the art, such modifications are encompassed within the spirit of the present invention as defined by the specification and the claims.

That which is claimed:

1. Apparatus comprising:

a substantially tubular member having first and second opposite end portions, an inner surface and an outer surface;

a first end wall having an inner surface and an outer surface and secured to and closing the first end portion of said substantially tubular member and having at least one first aperture extending therethrough between the inner and outer surfaces thereof;

a second end wall having an inner surface and an outer surface and secured to and closing the second end portion of said substantially tubular member and having at least one second aperture extending therethrough between the inner and outer surfaces thereof;

an intermediate wall disposed within said substantially tubular member intermediate said first and second end walls, said intermediate wall having a first surface facing said first end wall, a second surface facing said second end wall and a circumferential outer edge;

support means disposed within said substantially tubular member for fixedly securing said intermediate wall relative to the inner surface of said substantially tubular member whereby the circumferential outer edge of said intermediate wall and the inner surface of said tubular member define a substantially annular passage;

wherein the inner surface of said substantially tubular member, the inner surface of said first end wall, and the first surface of said intermediate wall define a first chamber;

wherein the inner surface of said substantially tubular member, the inner surface of said second end wall, and the second surface of said intermediate wall define a second chamber;

wherein said substantially annular passage provides fluid flow communication between said first and second chambers; and wherein the at least one first aperture and the at least one second aperture are both circular in cross section and the diameter of the at least one first aperture is greater than the diameter of the at least one second aperture.

2. Apparatus in accordance with claim 1 wherein the at least one first aperture is circular in cross section and the diameter thereof is greater than the maximum distance between the circumferential outer edge of said intermediate wall and the inner surface of said substantially tubular member.

3. Apparatus in accordance with claim 2 wherein the at least one second aperture is circular in cross section and the diameter thereof is less than the minimum distance between the circumferential outer edge of said intermediate wall and the inner surface of said substantially tubular member.

4. Apparatus in accordance with claim 3 wherein at least the portion of the inner surface of said substantially tubular member adjacent said intermediate wall is generally cylindrical and the circumferential outer edge of said intermediate wall is circular and coaxial with the generally cylindrical portion of the inner surface of said substantially tubular member.

5. Apparatus in accordance with claim 1 wherein the at least one second aperture is circular in cross section and the diameter thereof is less than the minimum distance between the circumferential outer edge of said intermediate wall and the inner surface of said substantially tubular member.

6. Apparatus in accordance with claim 1 wherein at least the portion of the inner surface of said substantially tubular member adjacent said intermediate wall is generally cylindrical having a radius and the circumferential outer edge of said intermediate wall is circular and coaxial with the generally cylindrical portion of the inner surface of said substantially tubular member.

7. Apparatus in accordance with claim 6 wherein the total cross sectional area of said at least one first aperture, the total cross sectional area of said substantially annular passage, and the total cross sectional area of said at least one second aperture are substantially equal.

8. Apparatus in accordance with claim 7 wherein the difference between the radius of the generally cylindrical portion of the inner surface of said substantially tubular member and the radius of the circumferential outer edge of said intermediate wall is less than the diameter of each of said at least one first aperture and greater than the diameter of each of said at least one second aperture.

9. Apparatus in accordance with claim 1 wherein said support means comprises means rigidly interconnecting said first end wall and said intermediate wall.

10. Apparatus in accordance with claim 1 wherein said support means comprises means rigidly interconnecting said second end wall and said intermediate wall.

11. Apparatus in accordance with claim 10 wherein said support means further comprises means rigidly interconnecting said first end wall and said intermediate wall.

12. Apparatus in accordance with claim 11 wherein said tubular member is characterized further to include a radially inwardly extending shoulder located at the second end portion of said tubular member, and wherein said second end wall is slidingly disposed within said tubular member and in abutting relation with said radially inwardly extending shoulder.

13. Apparatus in accordance with claim 12 wherein the first end wall is slidingly disposed within the first end portion of said substantially tubular member.

14. Apparatus in accordance with claim 11 wherein said substantially tubular member is characterized further to include a circumferential recess including a radially outwardly extending shoulder formed in the first end portion of said tubular member, and wherein said second end wall is slidingly disposed within said substantially tubular member adjacent the second end portion thereof.

15. Apparatus in accordance with claim 14 wherein said first end wall is disposed within said circumferential recess in the first end portion of said substantially tubular member in abutting relation with the radially outwardly extending shoulder.

16. Apparatus in accordance with claim 14 wherein said first end wall is fixedly secured to the first end portion of said substantially tubular member.

17. Apparatus in accordance with claim 11 wherein said substantially tubular member is characterized further to include:

an externally threaded portion of the outer surface thereof adjacent the second end portion thereof;

a generally cylindrical portion of the outer surface thereof adjacent the first end portion thereof; and at least one pair of parallel wrench flats on the outer surface thereof intermediate said externally threaded portion and said generally cylindrical portion.

18. A process for mixing a fluid comprising conveying said fluid through an apparatus which comprises:

a substantially tubular member having first and second opposite end portions, an inner surface and an outer surface;

a first end wall having an inner surface and an outer surface and secured to and closing the first end portion of said substantially tubular member and having at least one first aperture extending therethrough between the inner and outer surfaces thereof;

a second end wall having an inner surface and an outer surface and secured to and closing the second end portion of said substantially tubular member and having at least one second aperture extending therethrough between the inner and outer surfaces thereof;

an intermediate wall disposed within said substantially tubular member intermediate said first and second end walls, said intermediate wall having a first surface facing said first end wall, a second surface facing said second end wall and a circumferential outer edge;

support means disposed within said substantially tubular member for fixedly securing said intermediate wall relative to the inner surface of said substantially tubular member whereby the circumferential outer edge of said intermediate wall and the inner surface of said tubular member define a substantially annular passage;

wherein the inner surface of said substantially tubular member, the inner surface of said first end wall, and the first surface of said intermediate wall define a first chamber;

wherein the inner surface of said substantially tubular member, the inner surface of said second end wall, and the second surface of said intermediate wall define a second chamber;

wherein said substantially annular passage provides fluid flow communication between said first and second chambers; and wherein the at least one first aperture and the at least one second aperture are both circular in cross section and the diameter of the at least one first aperture is greater than the diameter of the at least one second aperture.

19. Apparatus comprising:

a substantially tubular member having first and second opposite end portions, an inner surface and an outer surface;

a first end wall having an inner surface and an outer surface and secured to and closing the first end portion of said substantially tubular member and having at least one first aperture extending therethrough between the inner and outer surfaces thereof;

a second end wall having an inner surface and an outer surface and secured to and closing the second end portion of said substantially tubular member and having at least one second aperture extending therethrough between the inner and outer surfaces thereof;

an intermediate wall disposed within said substantially tubular member intermediate said first and second end walls, said intermediate wall having a first surface facing said first end wall, a second surface facing said second end wall and a circumferential outer edge;

support means disposed within said substantially tubular member for fixedly securing said intermediate wall relative to the inner surface of said substantially tubular member whereby the circumferential outer edge of said intermediate wall and the inner surface of said tubular member define a substantially annular passage;

wherein the inner surface of said substantially tubular member, the inner surface of said first end wall, and the first surface of said intermediate wall define a first chamber;

wherein the inner surface of said substantially tubular member, the inner surface of said second end wall, and the second surface of said intermediate wall define a second chamber;

wherein said substantially annular passage provides fluid flow communication between said first and second chambers;

wherein the at least one first aperture is circular in cross section and the diameter thereof is greater than the maximum distance between the circumferential outer edge of said intermediate wall and the inner surface of said substantially tubular member; and wherein the at least one second aperture is circular in cross section and the diameter thereof is less than the minimum distance between the circumferential outer edge of said intermediate wall and the inner surface of said substantially tubular member.

* * * * *